US011408192B2

(12) United States Patent
Schwiebert

(10) Patent No.: US 11,408,192 B2
(45) Date of Patent: Aug. 9, 2022

(54) PORTABLE, ERGONOMIC, AND SELECTIVELY ADJUSTABLE UMBRELLA AND SEAT SUPPORT STRUCTURE

(71) Applicant: Mike Schwiebert, Green Cove Springs, FL (US)

(72) Inventor: Mike Schwiebert, Green Cove Springs, FL (US)

( * ) Notice: Subject to any disclaimer, the term of this patent is extended or adjusted under 35 U.S.C. 154(b) by 0 days.

(21) Appl. No.: 17/160,886

(22) Filed: Jan. 28, 2021

(65) Prior Publication Data

US 2021/0145169 A1 May 20, 2021

Related U.S. Application Data

(63) Continuation-in-part of application No. 16/656,634, filed on Oct. 18, 2019, now Pat. No. 10,925,360.

(51) Int. Cl.

| | |
|---|---|
| ***E04H 4/14*** | (2006.01) |
| ***E04H 12/22*** | (2006.01) |
| ***A45B 25/00*** | (2006.01) |
| ***A45B 17/00*** | (2006.01) |
| ***A47B 37/04*** | (2006.01) |

(Continued)

(52) U.S. Cl.

CPC ..... *E04H 4/14* (2013.01); *A45B 23/00* (2013.01); *A47B 13/16* (2013.01); *A47B 37/04* (2013.01); *E04H 12/2238* (2013.01); *A45B 2023/0012* (2013.01); *A45B 2025/003* (2013.01); *A45B 2200/1063* (2013.01); *A63B 2071/026* (2013.01)

(58) Field of Classification Search

CPC ..... E04H 12/2238; A45B 2023/0012; A45B 2025/003

USPC ..... 248/910, 514, 516, 520, 521, 523, 371, 248/346.2; 108/50.12, 25, 150, 157.13; 4/496

See application file for complete search history.

(56) References Cited

U.S. PATENT DOCUMENTS 63,517 A * 4/1867 Heermance ..... A47G 33/1226 248/516
1,268,734 A * 6/1918 Lay ..... A46B 5/0083 81/177.8

(Continued)

FOREIGN PATENT DOCUMENTS

CH 255273 A * 6/1948 ..... A45B 17/00
DE 3036340 A1 * 6/1982 ..... A47B 37/04

(Continued)

*Primary Examiner* — Robert Canfield
(74) *Attorney, Agent, or Firm* — Ashkan Najafi

(57) ABSTRACT

A beverage holding support structure, for use in a pool, includes a base configured to be disposed at a non-equilibrium sloped position within a pool relative to a horizontal plane and parallel to a sloped bottom surface of the pool, a base connector connected to the base, an articulating mechanism adjustably coupled to the base connector and extended upwardly therefrom, at least one extension pole aligned with a centrally registered longitudinal axis and statically affixed to an upper portion of the articulating mechanism, and a cup holder tray attached to the at least one extension pole. The beverage holding support structure has a center of gravity configured to prohibit the base from being tipped over from the non-equilibrium sloped position while the cup holder tray is maintained at a horizontal position parallel to the horizontal plane above a top water level surface of the pool.

11 Claims, 12 Drawing Sheets

(51) Int. Cl.

| | |
|---|---|
| ***A47B 13/16*** | (2006.01) |
| ***A45B 23/00*** | (2006.01) |
| *A63B 71/02* | (2006.01) |

(56) References Cited

U.S. PATENT DOCUMENTS 2,555,226 A * 5/1951 Draughn ..... B25G 3/38 403/97
2,805,109 A * 9/1957 Kopmar ..... A45B 23/00 108/50.12
D202,353 S * 9/1965 Wester ..... D26/113
3,434,484 A * 3/1969 Dilullo ..... A45B 17/00 108/6
3,624,732 A * 11/1971 Bowden ..... A47B 37/04 108/151
3,953,029 A * 4/1976 Boyd ..... F16M 5/00 248/161
4,023,582 A * 5/1977 Buzzella ..... A45B 23/00 52/73
4,222,680 A * 9/1980 Browning ..... E04H 12/2238 403/56
4,920,897 A * 5/1990 Reed ..... A47B 37/04 108/150
5,197,394 A * 3/1993 Schmidt ..... A47B 13/16 108/150
5,505,645 A * 4/1996 Engler, Jr. ..... A45B 23/00 135/16
5,911,399 A * 6/1999 Mannion ..... F16M 13/00 135/88.06
9,192,214 B2 * 11/2015 Gambill ..... A45B 23/00
2004/0129184 A1 * 7/2004 Kraker ..... E04H 12/2223 108/50.12
2006/0124157 A1 * 6/2006 Bayour ..... E05G 1/005 126/600
2007/0246091 A1 * 10/2007 Becker ..... A45B 3/00 135/16
2009/0189035 A1 * 7/2009 Gambill ..... A45B 23/00 248/218.4
2011/0265836 A1 * 11/2011 Wilkins ..... A45B 3/02 135/33.7
2011/0278248 A1 * 11/2011 Pron ..... A45B 3/00 29/428
2011/0297196 A1 * 12/2011 Durante ..... E05D 11/1007 135/15.1
2012/0326001 A1 * 12/2012 Suutarinen ..... E04H 12/2284 248/521
2013/0031712 A1 * 2/2013 Gossett ..... A47C 3/34 4/496
2015/0366180 A1 * 12/2015 Chmura ..... A01K 97/10 248/125.7
2016/0015137 A1 * 1/2016 Sasaki ..... A45B 17/00 135/20.1
2016/0106187 A1 * 4/2016 Sloan ..... A45B 23/00 135/16
2016/0208509 A1 * 7/2016 Ngu ..... E04H 12/2284
2016/0242537 A1 * 8/2016 Hernandez ..... A47B 9/08
2017/0042321 A1 * 2/2017 Clause ..... A47B 13/003

FOREIGN PATENT DOCUMENTS

DE 20317530 U1 * 4/2004 ..... A45B 25/00
DE 20317552 U1 * 5/2004 ..... A45B 11/00
EP 0306542 A1 * 3/1989 ..... A45B 23/00
EP E P-1530918 A2 * 5/2005 ..... A45B 25/00
GB 450919 A * 7/1936 ..... A45B 17/00

* cited by examiner

PORTABLE, ERGONOMIC, AND SELECTIVELY ADJUSTABLE UMBRELLA AND SEAT SUPPORT STRUCTURE

CROSS REFERENCE TO RELATED APPLICATIONS

This is a continuation-in-part application of currently pending U.S. patent application Ser. No. 16/656,634, filed Oct. 18, 2019, the entire disclosure of which is incorporated by reference herein.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to umbrella canopies and, more particularly, to a portable, ergonomic, and selectively adjustable umbrella support structure and associated seat for providing user enjoyment in a pool environment.

Prior Art

There are a wide variety of pool accessories that are known in the art. Some of these are buoyant devices that allow a user to sit or sleep thereon, all the while enjoying the environment of the pool. Spending time in a pool one of the most enjoyable activities during a hot summer day. Similarly, enjoying one's favorite beverage is another method to beat the heat of the hot summer days. It is, however, inconvenient for a user to consume a beverage while being in the pool, even if the user is using the conventionally known buoyant devices, commonly referred to as floats. This is because the user has to constantly hold on to the beverage container, while taking care that the beverage does not spill into the water or the water of the pool does not accidentally enter the beverage container. It is also desired that the user may enjoy their favorite beverage in the pool environment while also being protected from the harmful sunrays.

Accordingly, a need remains for a portable, ergonomic, and selectively adjustable umbrella support structure and associated seat in order to overcome at least one aforementioned shortcoming. The exemplary embodiment(s) satisfy such a need by providing a portable, ergonomic, and selectively adjustable umbrella support structure and associated seat that is convenient and easy to use, lightweight yet durable in design, versatile in its applications, and designed for providing user enjoyment in a pool environment.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a beverage holding support structure for holding a beverage in a pool. These and other objects, features, and advantages of the non-limiting exemplary embodiment(s) are provided by a beverage holding support structure including a beverage holding support structure including a base configured to be disposed at a non-equilibrium sloped position within a pool relative to a horizontal plane and parallel to a sloped bottom surface of the pool, a base connector having a centrally registered longitudinal axis and being connected to the base, an articulating mechanism adjustably coupled to the base connector and extended upwardly therefrom, at least one extension pole aligned with the centrally registered longitudinal axis and statically affixed to an upper portion of the articulating mechanism, and a cup holder tray attached to the at least one extension pole. Advantageously, the beverage holding support structure has a center of gravity located proximate to the base and distal to the cup holder tray. Advantageously, the center of gravity is configured to prohibit the base from being tipped over from the non-equilibrium sloped position while the cup holder tray is maintained at a horizontal position parallel to the horizontal plane above a top water level surface of the pool.

In a non-limiting exemplary embodiment, the base, the base connector, and a lower portion of the articulating mechanism are configured to synchronously remain at the non-equilibrium sloped position and angularly offset from the horizontal plane and the centrally registered longitudinal axis, respectively, while the cup holder tray is articulated above the top water level surface of the pool.

In a non-limiting exemplary embodiment, the at least one extension pole and an upper portion of the articulating mechanism are configured to be freely pivoted in sync relative to the non-equilibrium sloped position of the base, the base connector, and a lower portion of the articulating mechanism such that the cup holder tray is maintained at an equilibrium position parallel to the horizontal plane and above the top water level surface of the pool.

In a non-limiting exemplary embodiment, the articulating mechanism includes a first connector having a hollow tubular top end attached to the at least one extension pole, and further having a first adjustable portion provided with a first plurality of teeth opposed from the hollow tubular top end. A second connector has a hollow tubular bottom end attached to the base connector, and further has a second adjustable portion provided with a second plurality of teeth opposed from the hollow tubular bottom end. A rubber washer is intercalated between the first plurality of teeth and the second plurality of teeth. Advantageously, the first plurality of teeth are rotatably affixed to the second plurality of teeth such that the at least one extension pole is selectively articulated between alternate angles relative to the non-equilibrium sloped position of the base and about a fulcrum axis registered orthogonal to the centrally registered longitudinal axis.

In a non-limiting exemplary embodiment, the articulating mechanism further includes an exterior washer positioned exterior of the second adjustable portion, and a first fastener is passed through the first adjustable portion, the second adjustable portion, and the exterior washer. A knob is in threaded engagement with the first fastener and the exterior washer for selectively adjusting a tilt angle of the first adjustable portion relative to the second adjustable portion.

In a non-limiting exemplary embodiment, an umbrella canopy is attached to the at least one extension pole.

There has thus been outlined, rather broadly, the more important features of non-limiting exemplary embodiment (s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
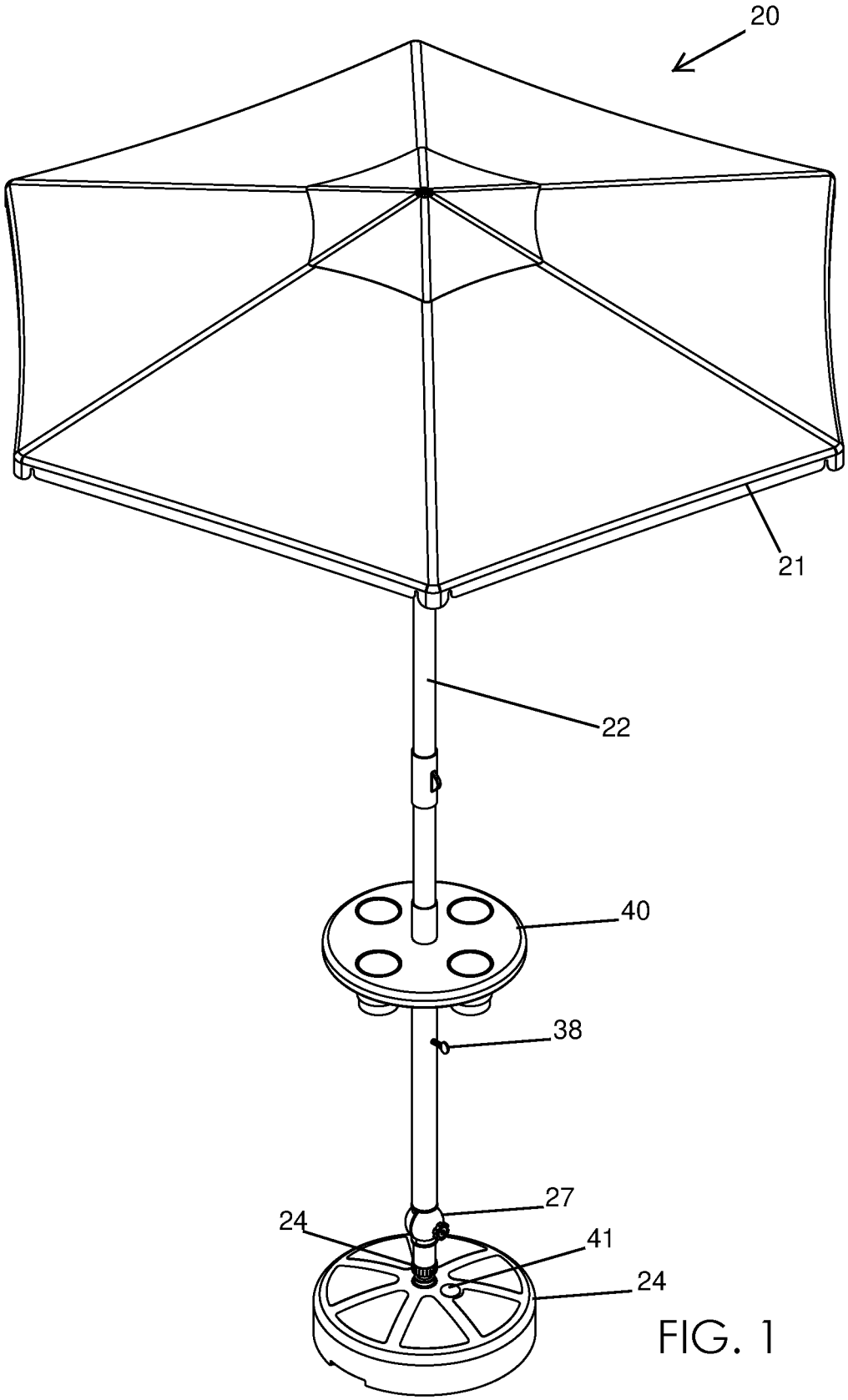
FIG. 1 is a perspective view of a selectively adjustable umbrella support structure for providing user enjoyment within a pool, in accordance with a non-limiting exemplary embodiment of the present disclosure.
Figure 2:
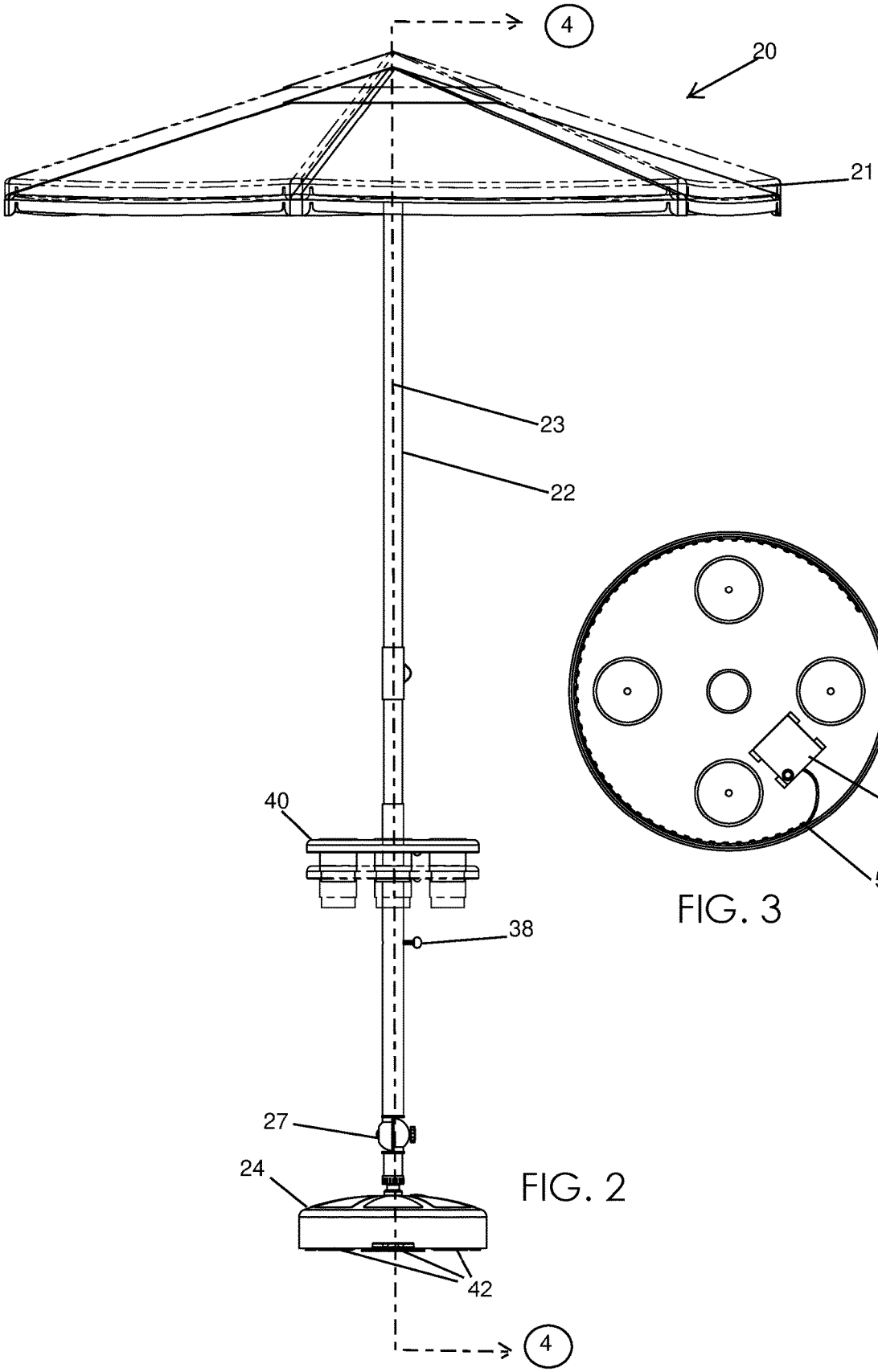
FIG. 2 is a side elevational view of the support structure shown in FIG. 1 wherein the umbrella canopy and cup shoulder are vertically reciprocated.
Figure 3:
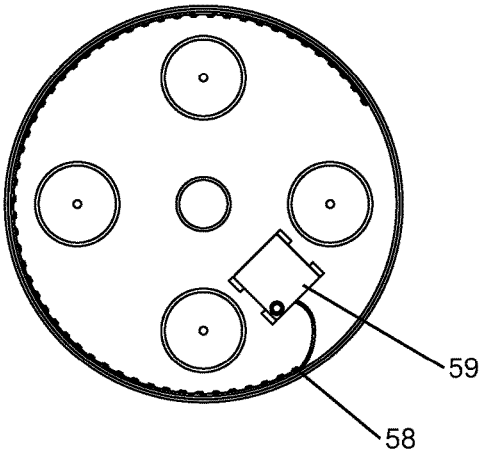
FIG. 3 is a bottom plan view of the cup holder showing LEDs and an associated controller attached thereto.
Figures 4, 4A:
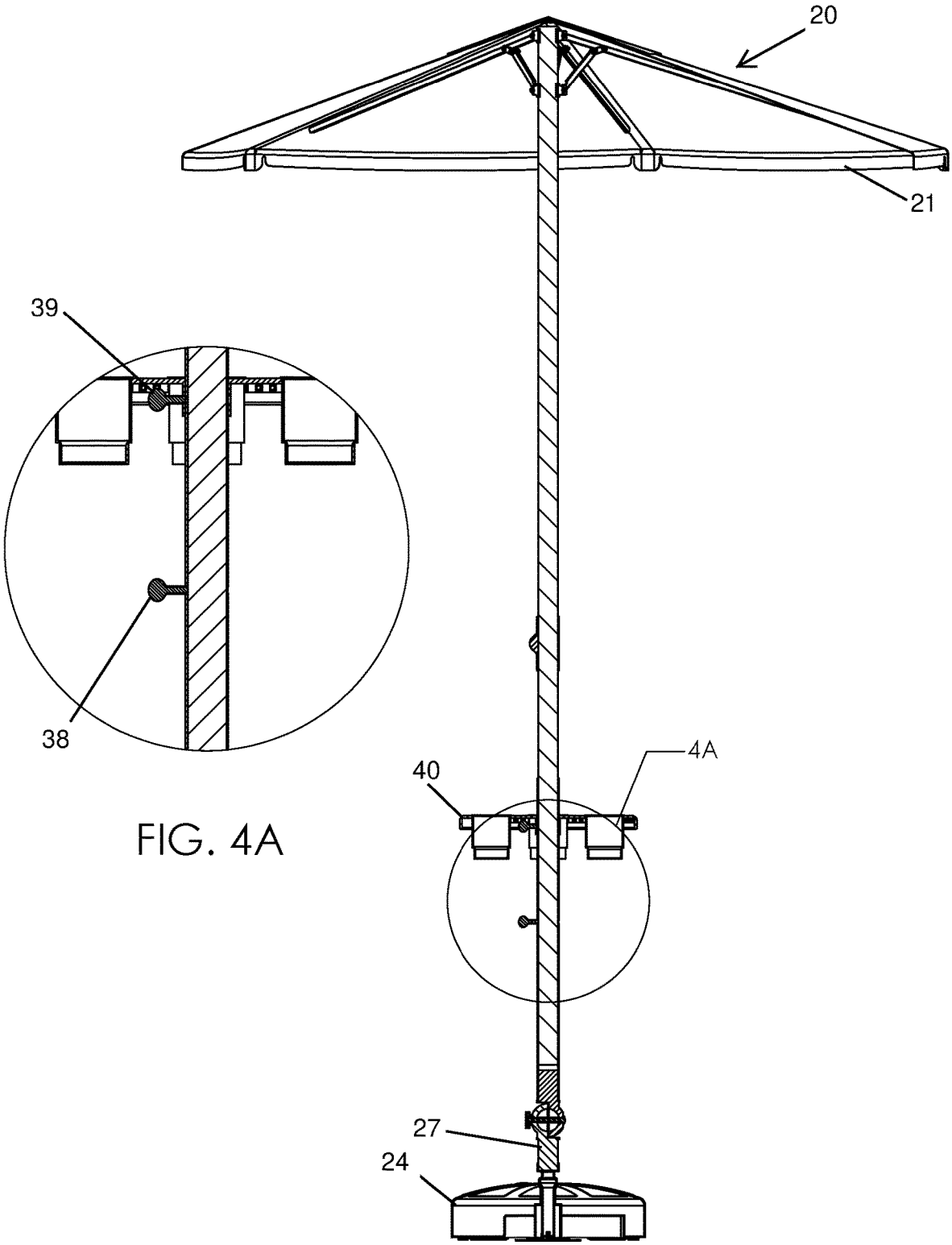
FIG. 4 is a cross-sectional view taken along line 4-4 in FIG. 3.
FIG. 4A is an enlarged view of section 4A taken in FIG. 4.
Figure 5:
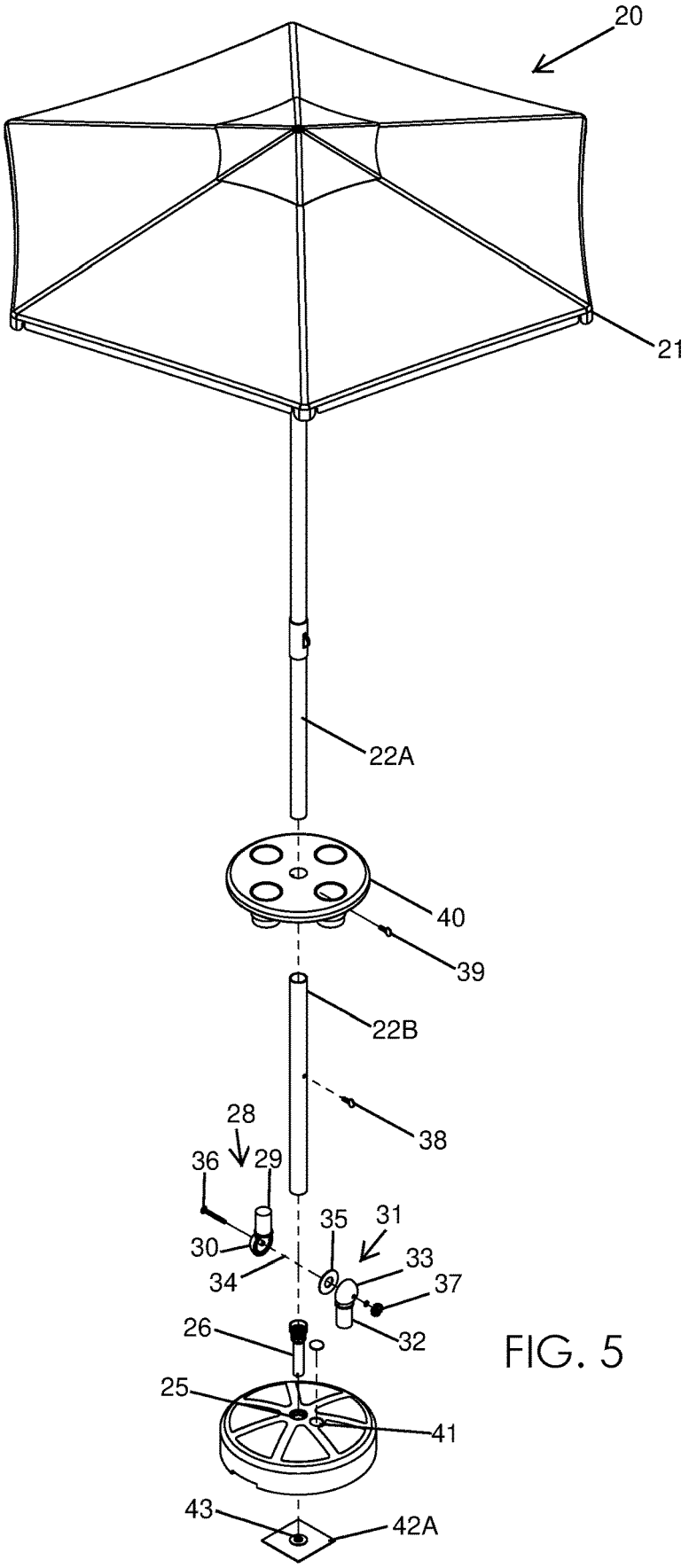
FIG. 5 is an exploded view of the support structure shown in FIG. 1.
Figure 6:
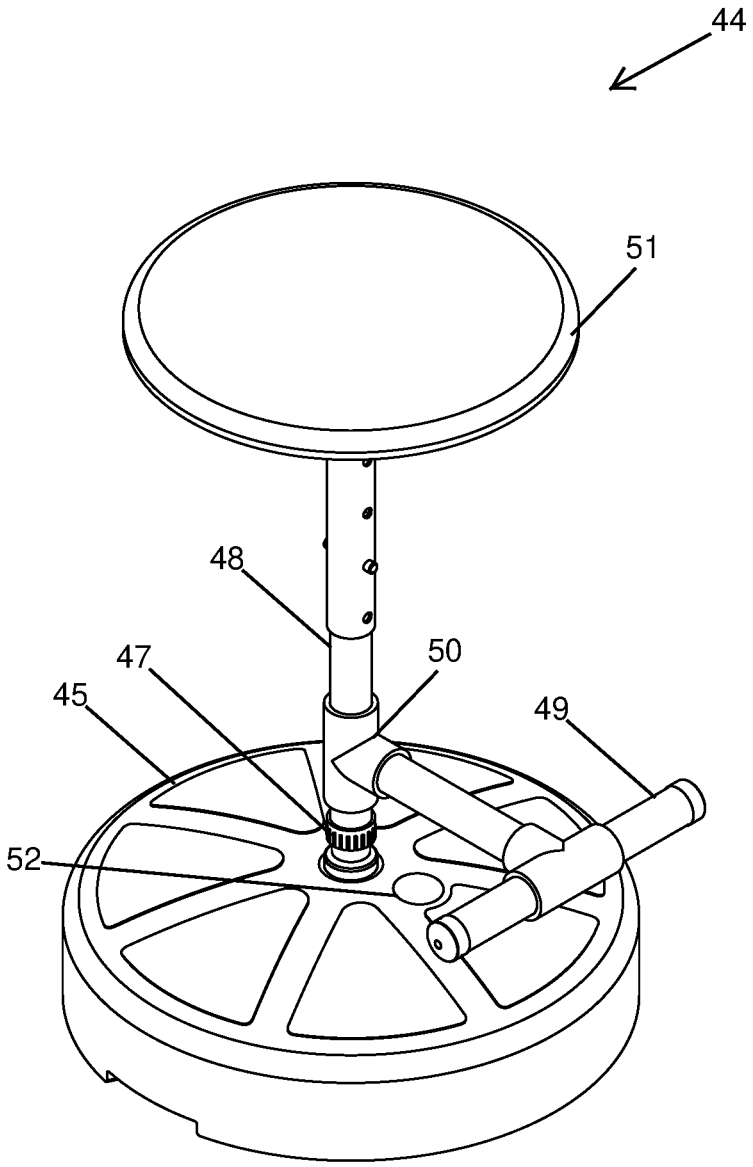
FIG. 6 is a perspective view of a seat selectively disposed adjacent to the support structure shown in FIG. 1.
Figure 7:
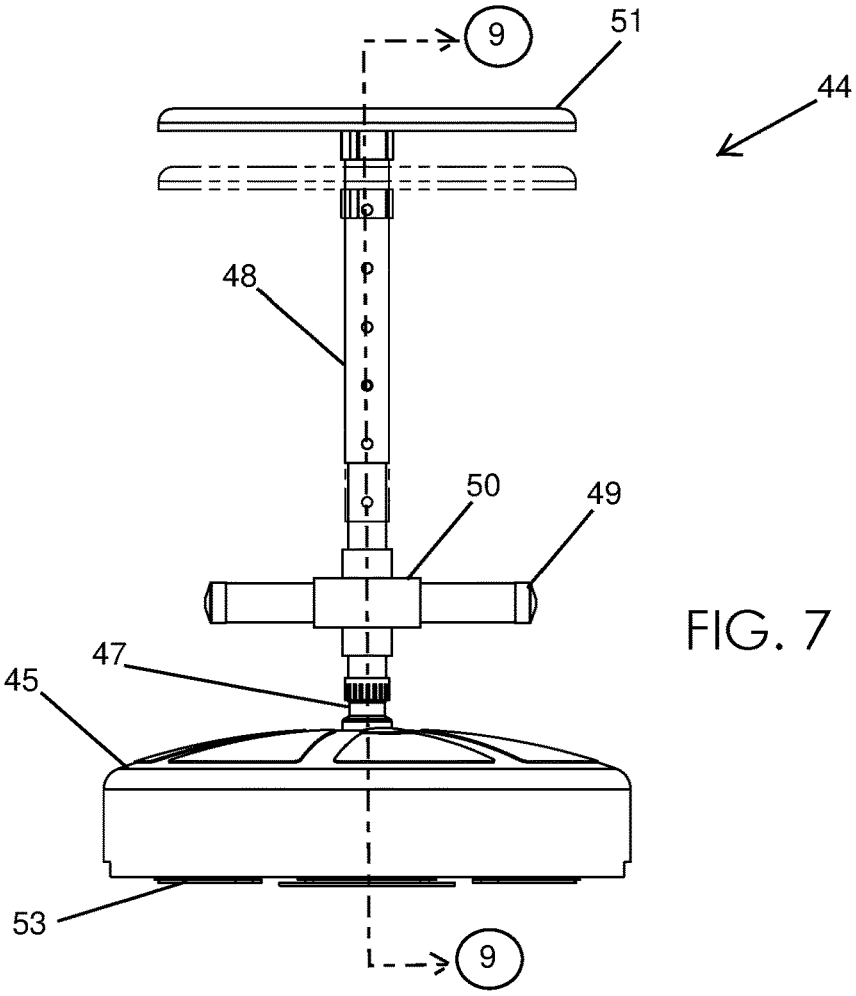
FIG. 7 is a front elevational view of the seat shown in FIG. 1, wherein the seat cushion is vertically reciprocated.
Figure 8:
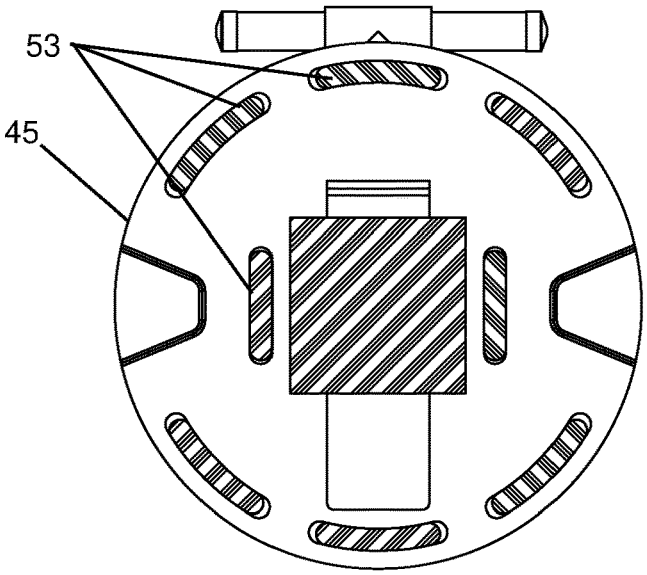
FIG. 8 is a bottom plan view of a seat base of the seat shown in FIG. 6.
Figure 9:
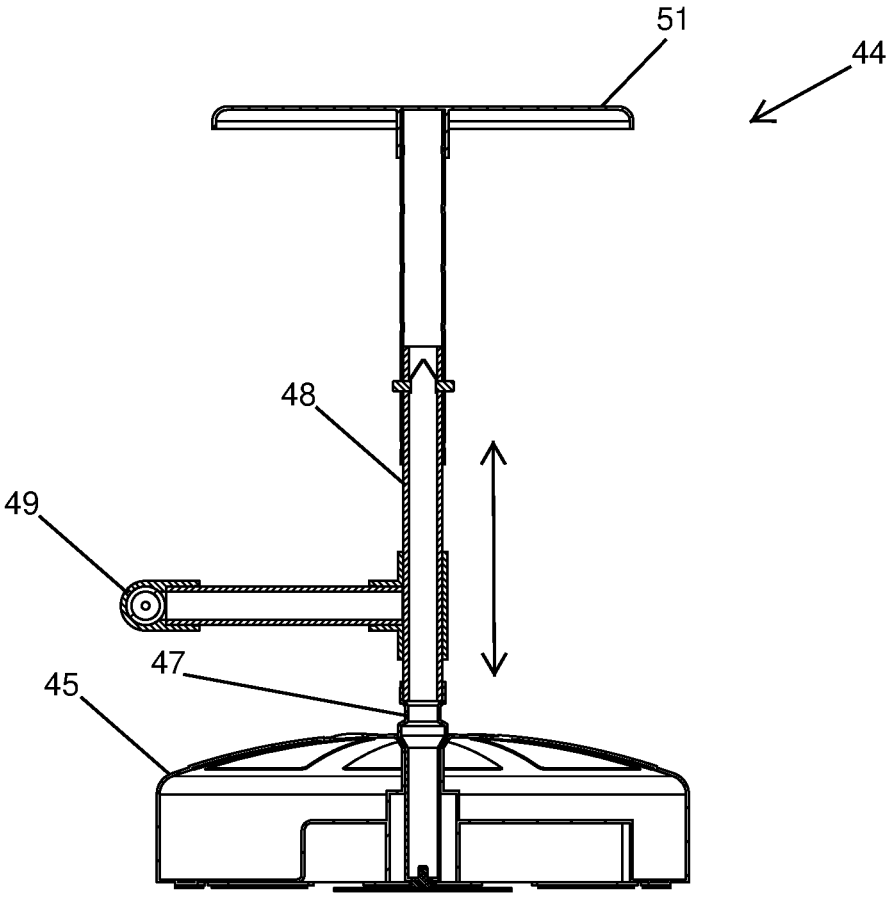
FIG. 9 is a cross-sectional view of the seat taken along line 9-9 in FIG. 7.
Figure 10:
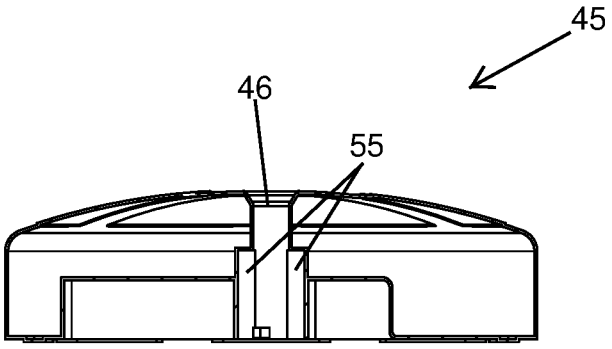
FIG. 10 is a cross-sectional view of the seat base taken along line 9-9 shown in FIG. 7.
Figure 11:
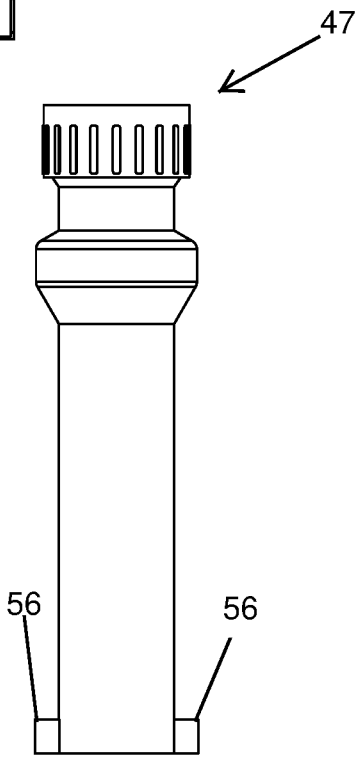
FIG. 11 is an enlarged front elevational view of a seat base connector of the seat shown in FIG. 12.
Figure 12:
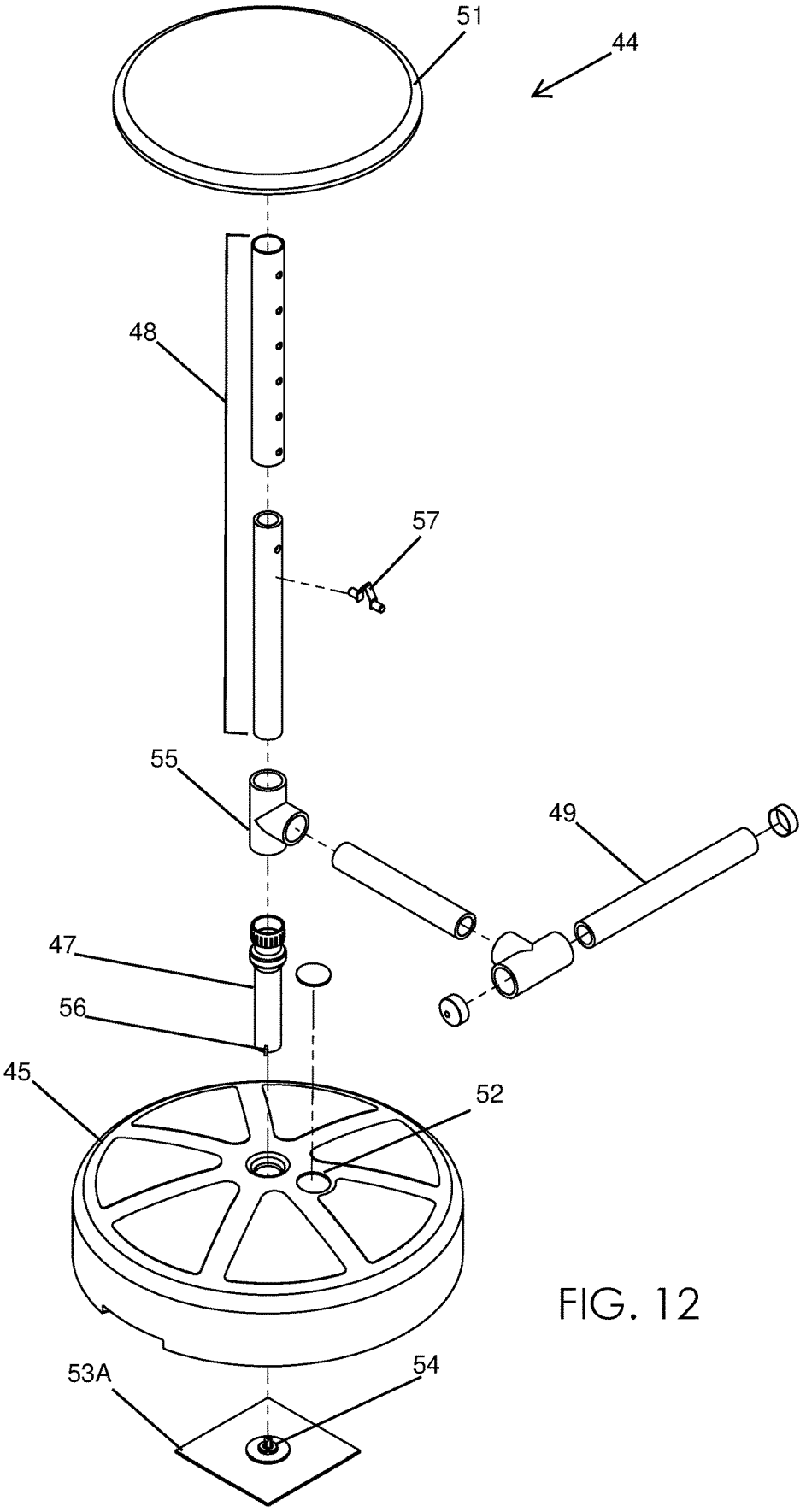
FIG. 12 is an exploded view of the seat shown in FIG. 6.
Figure 13:
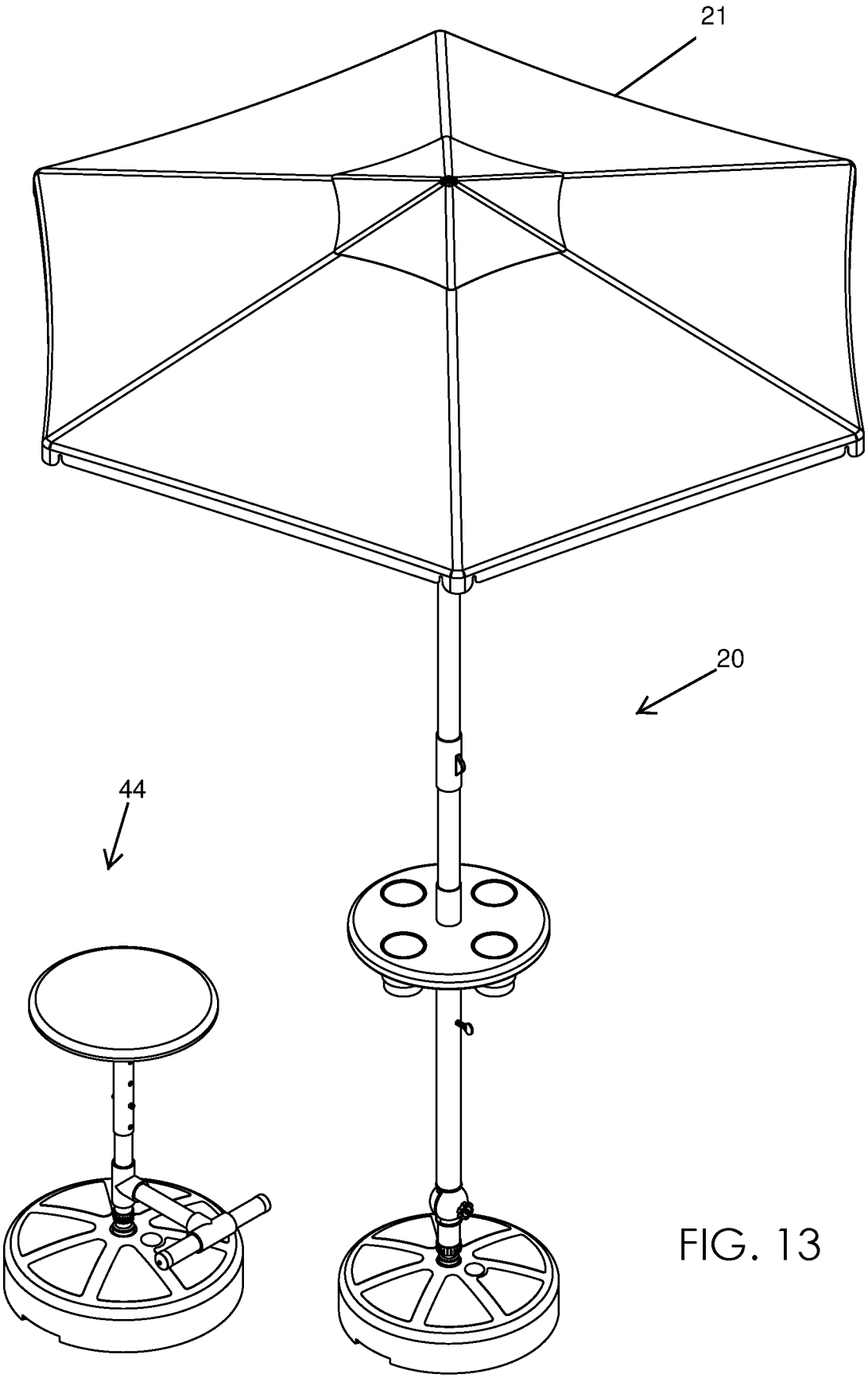
FIG. 13 is a perspective view showing a combination of the umbrella support structure and seat, in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment (s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means 15% of the numerical.

If used herein, "substantially" means largely if not wholly that which is specified but so close that the difference is insignificant.

The non-limiting exemplary embodiment(s) are referred to generally in FIGS. 1-16 and are intended to provide a selectively adjustable umbrella support structure 20 for providing user enjoyment within a pool. The support structure 20 includes an umbrella 21 having at least one extension pole 22 provided with a centrally registered longitudinal axis 23, and a base 24 capable of being positioned on a bottom surface of a pool wherein the base 24 has a substantially central through-hole 25 axially aligned with the centrally registered longitudinal axis 23. An umbrella base connector 26 is seated within the through-hole 25 and extended vertically upward from the base 24 along the centrally registered longitudinal axis 23. An articulating mechanism 27 is adjustably coupled to the at least one extension pole 22 of the umbrella 21 and to the umbrella base connector 26. Such an articulating mechanism 27 includes a first connector 28 having a hollow tubular top end 29 attached to the at least one extension pole 22 of the umbrella 21, and further has a first adjustable portion 30 opposed from the hollow tubular top end 29. A second connector 31 has a hollow tubular bottom end 32 attached to the umbrella base connector 26, and further has a second adjustable portion 33 opposed from the hollow tubular bottom end 32. Advantageously, the first adjustable portion 30 is rotatably affixed to the second adjustable portion 33 such that the umbrella 21 and the at least one extension pole 22 of the umbrella 21 are selectively articulated relative to a stationary position of the base 24 and about a fulcrum axis 34 registered orthogonal to the centrally registered longitudinal axis 23. Such a structural configuration provides the new, useful, and unexpected result of facilitating user enjoyment while drinking beverages in a pool environment by selectively rotating the umbrella 21 to a desired tilt angle relative to a vertically upright position for providing shade during extends hours.

In a non-limiting exemplary embodiment, the articulating mechanism 27 includes a washer 35 intermediately seated between the first adjustable portion 30 and the second adjustable portion 33. A first fastener 36 is passed through the first adjustable portion 30, the second adjustable portion 33, and the washer 35. A knob 37 is in threaded engagement with the first fastener 36 for selectively adjusting a tilt angle of the first adjustable portion 30 relative to the second adjustable portion 33. Such a structural configuration provides the new, useful, and unexpected result of facilitating controlled articulation of the umbrella 21 with respect to the umbrella base connector 26 and the base 24.

In a non-limiting exemplary embodiment, the at least one extension pole 22 includes a first pole 22A, and a second pole 22B in a telescopic engagement with the first pole 22A, and a second fastener 38 configured to selectively lock the first pole 22A to the second pole 22B. Such a structural configuration provides the new, useful, and unexpected result of varying the height of the umbrella 21 depending upon the heights of the users. For example, the height may be set to minimum for children, and the height may be set at maximum for adults.

In a non-limiting exemplary embodiment, the support structure 20 further includes a third fastener 39, and a cup holder tray 40 linearly reciprocated along at least one of the first pole 22A and the second pole 22B and secured thereto via the third fastener 39. Advantageously, the cup holder tray 40 is displaced along the centrally registered longitudinal axis 23 and remains positioned above the base 24. Such a structural configuration provides the new, useful, and unexpected result of selectively securing the cup holder tray 40 to the first 22A or the second 22B pole depending on the height of the users as well as the depth of the water in the pool, thereby ensuring that a beverage container is adequately held within the cup holder tray 40 above the water surface.

In a non-limiting exemplary embodiment, the base 24 has a hollow configuration and an opening 41 in fluid communication therewith for receiving and housing a ballast material therein. Such a structural configuration provides the new, useful, and unexpected result of providing an optimal weight to the base 24 that is required for underwater stability. The ballast material is preferably a weighted material such as sand, concrete, etc. for anchoring the base 24 at a bottom surface of the pool. It may also be a buoyant material (e.g., foam, etc.) for suspending the support structure 10 at a buoyant state above the bottom surface of the pool.

In a non-limiting exemplary embodiment, the support structure 20 further includes a plurality of umbrella gripper pads 42 attached to and juxtaposed at an exterior bottom surface of the base 24. Advantageously, at least one umbrella gripper pad 42A from the plurality of umbrella gripper pads 42 has a first protrusion 43 (rectilinear alignment pin) extended upwardly through the through-hole 25 along the centrally registered longitudinal axis 23. The through-hole 25 is suitably sized and shaped for succinctly receiving the alignment pin therein for ensuring vertical stability of umbrella base connector 46. Thus, a diameter of the through-hole 25 is slightly larger than a diameter of the alignment pin (first protrusion 43). In this manner, the first protrusion 43 is detachably connected to the umbrella base connector 26. Such a structural configuration provides the new, useful, and unexpected result of ensuring the ballast material does not undesirably leak from the base 24 thereby facilitating secure placement of the support structure underwater.

In a non-limiting exemplary embodiment, the support structure 20 further includes an array of LEDs 58 operatively configured at a bottom surface of the cup holder tray 40 and along a periphery of the cup holder tray 40. The array of LEDs 58 is controllable via an LED controller 59. A power source may be housed at the controller 59. Of course, the controller 59 may be equipped with a transceiver for wirelessly communication with a remote user interface via RF, infrared, BLUETOOTH® signal protocols. Such a structural configuration provides the new, useful, and unexpected result of illuminating the bottom surface of the cup holder tray 40, thereby providing an aesthetically pleasing appearance to the cup holder tray 40, especially in a post sunset environment or in an environment with dim lighting.

In a non-limiting exemplary embodiment, the support structure 20 further includes a portable seat 44 for receiving a user buttock thereon. Such a seat 44 is located adjacent to the umbrella 21 and includes a seat base 45 capable of being positioned on a bottom surface of a pool or buoyantly displaced within the pool. The seat base 45 has an axial bore 46. A seat base connector 47 is linearly inserted within the axial bore 46, and an anchor pole 48 is attached to the seat base connector 47. Notably, the anchor pole 48 has a telescopic configuration, wherein the height of the anchor pole 48 is varied via a fourth fastener 57. A leg rest 49 is also provided. A three-way coupling 50 is attached to the anchor pole 48 and the leg rest 49 to facilitate linear reciprocation of the leg rest 49 with respect to the anchor pole 48. A seat cushion 51 is fitted at a top end of the anchor pole 48. Such a structural configuration provides the new, useful, and unexpected result of providing the user with an option to support their buttocks on a seat while enjoying a beverage in the pool.

In a non-limiting exemplary embodiment, the seat base 45 has a hollow configuration and an opening 52 for receiving in a ballast material therein. Such a structural configuration provides the new, useful, and unexpected result of providing an optimal weight to the seat base that is required for underwater stability. The ballast material is preferably a weighted material such as sand, concrete, etc. for anchoring the seat base 45 at a bottom surface of the pool. It may also be a buoyant material (e.g., foam, etc.) for suspending the portable seat 44 at a buoyant state above the bottom surface of the pool.

In a non-limiting exemplary embodiment, the support structure 20 further includes a plurality of seat base gripper pads 53 attached to and juxtaposed at an exterior bottom surface of the seat base 45. Advantageously, at least one seat base gripper pad 53A has a second protrusion 54 connected with the seat base connector 47. The second protrusion 54 (rectilinear second alignment pin) extends upwardly through the axial bore 46 along a centrally registered longitudinal axis of the seat base 45. The axial bore 46 is suitably sized and shaped for succinctly receiving the second alignment pin therein for ensuring vertical stability of seat base connector 47. Thus, a diameter of the axial bore 46 is slightly larger than a diameter of the second alignment pin (second protrusion 54). Such a structural configuration provides the new, useful, and unexpected result of ensuring the ballast material does not undesirably leak from the seat base 45 thereby facilitating secure placement of the support structure underwater.

In a non-limiting exemplary embodiment, a pair of diametrically opposed slots 55 are located within the axial bore 46. Advantageously, the seat base connector 47 has a pair of diametrically opposed fingers 56 statically affixed thereto. Such fingers are linearly and slidably inserted into the opposed slots 55 for receiving and locking the seat base connector 47 to the seat base 45. Such a structural configuration provides the new, useful, and unexpected result of locking the movement the seat base connector 47 and the anchor pole 48 to the seat base 45 underwater.

In a non-limiting exemplary embodiment, the three-way coupling is directly affixed 50 to the leg rest 49 and the anchor pole 48. Such a structural configuration provides the new, useful, and unexpected result of facilitating the variation in the height of the leg rest depending the height of the user seated on the seat.

The present disclosure further includes a support structure 20 for providing user enjoyment within a pool. The support structure 20 includes a portable umbrella 21 having at least one extension pole 22 provided with a centrally registered longitudinal axis 23, a portable base 24 capable of being positioned on a bottom surface of a pool wherein the base 24 has a substantially central through-hole 25 axially aligned with the centrally registered longitudinal axis 23, an umbrella base connector 26 seated within the through-hole 25 and extended vertically upward from the base 24 along the centrally registered longitudinal axis 23, and an articulating mechanism 27 adjustably coupled to the at least one extension pole 22 of the umbrella 21 and to the umbrella base connector 26. Advantageously, the articulating mechanism 27 includes a first connector 28 having a hollow tubular top end 29 attached to the at least one extension pole 22 of the umbrella 21, and further has a first adjustable portion 30 opposed from the hollow tubular top end 29. The articulating mechanism 27 further includes a second connector 31 having a hollow tubular bottom end 32 attached to the umbrella base connector 26, and further has a second adjustable portion 33 opposed from the hollow tubular bottom end 32. Advantageously, the first adjustable portion 30 is rotatably affixed to the second adjustable portion 33 such that the umbrella 21 and the at least one extension pole 22 of the umbrella 21 are selectively articulated relative to a stationary position of the base 24 and about a fulcrum axis 34 registered orthogonal to the centrally registered longitudinal axis 23. Such a structural configuration provides the new, useful, and unexpected result of facilitating user enjoyment while drinking beverages in a pool environment by selectively rotating the umbrella 21 to a desired tilt angle relative to a vertically upright position for providing shade during extends hours.

The present disclosure further includes a method of utilizing a support structure 20 for providing user enjoyment within a pool. Such a method includes the steps of: accessing a pool; providing a portable umbrella 21 having at least one extension pole 22 equipped with a centrally registered longitudinal axis 23; providing and positioning a portable base 24 on a bottom surface of the pool, wherein the base 24 has a substantially central through-hole 25 axially aligned with the centrally registered longitudinal axis 23; providing and seating an umbrella base connector 26 within the through-hole 25 and extending the umbrella base connector 26 vertically upward from the base 24 along the centrally registered longitudinal axis 23; and providing and adjustably coupling an articulating mechanism 27 to the at least one extension pole 22 of the umbrella 21 and to the umbrella base connector 26. Such an articulating mechanism 27 includes a first connector 28 having a hollow tubular top end 29 attached to the at least one extension pole 22 of the umbrella 21, and further has a first adjustable portion 30 opposed from the hollow tubular top end 29. The articulating mechanism 27 further includes a second connector 31 having a hollow tubular bottom end 32 attached to the umbrella base connector 26, and further having a second adjustable portion 33 opposed from the hollow tubular bottom end 32. Such a combination of method steps provide the new, useful, and unexpected result of allowing the user to consume their favorite beverage while also enjoying in the pool.

The method further includes the step of: rotatably affixing the first adjustable portion 30 to the second adjustable portion 33 such that the umbrella 21 and the at least one extension pole 22 of the umbrella 21 are selectively articulated relative to a stationary position of the base 24 and about a fulcrum axis 34 registered orthogonal to the centrally registered longitudinal axis 23. Such a combination of method steps provide the new, useful, and unexpected result of facilitating controlled articulation of the umbrella with respect to the umbrella base connector and the base. Thus, the user can drink beverages in a pool environment while selectively rotating the umbrella 21 to a desired tilt angle relative to a vertically upright position for providing shade during extends hours.

Referring to FIGS. 1-16 in general, a beverage holding support structure 20, for use in a pool, includes a base 24 configured to be disposed at a non-equilibrium sloped position 80 within a pool 81 relative to a horizontal plane 82 and parallel to a sloped bottom surface 83 of the pool 81, a base connector 26 having a centrally registered longitudinal axis 23 and being connected to the base 24, an articulating mechanism 27 adjustably coupled to the base connector 26 and extended upwardly therefrom, at least one extension pole 22 aligned with the centrally registered longitudinal axis 23 and statically affixed to an upper portion of the articulating mechanism 27, and a cup holder tray 40 attached to the at least one extension pole 22. Advantageously, the support structure 20 has a center of gravity 86 located proximate to the base 24 and distal to the cup holder tray 40. Advantageously, the center of gravity 86 is configured to prohibit the base 24 from being tipped over from the non-equilibrium sloped position 80 while the cup holder tray 40 is maintained at a horizontal position 87 parallel to the horizontal plane 82 above a top water level surface 88 of the pool 81.

Figure 14:
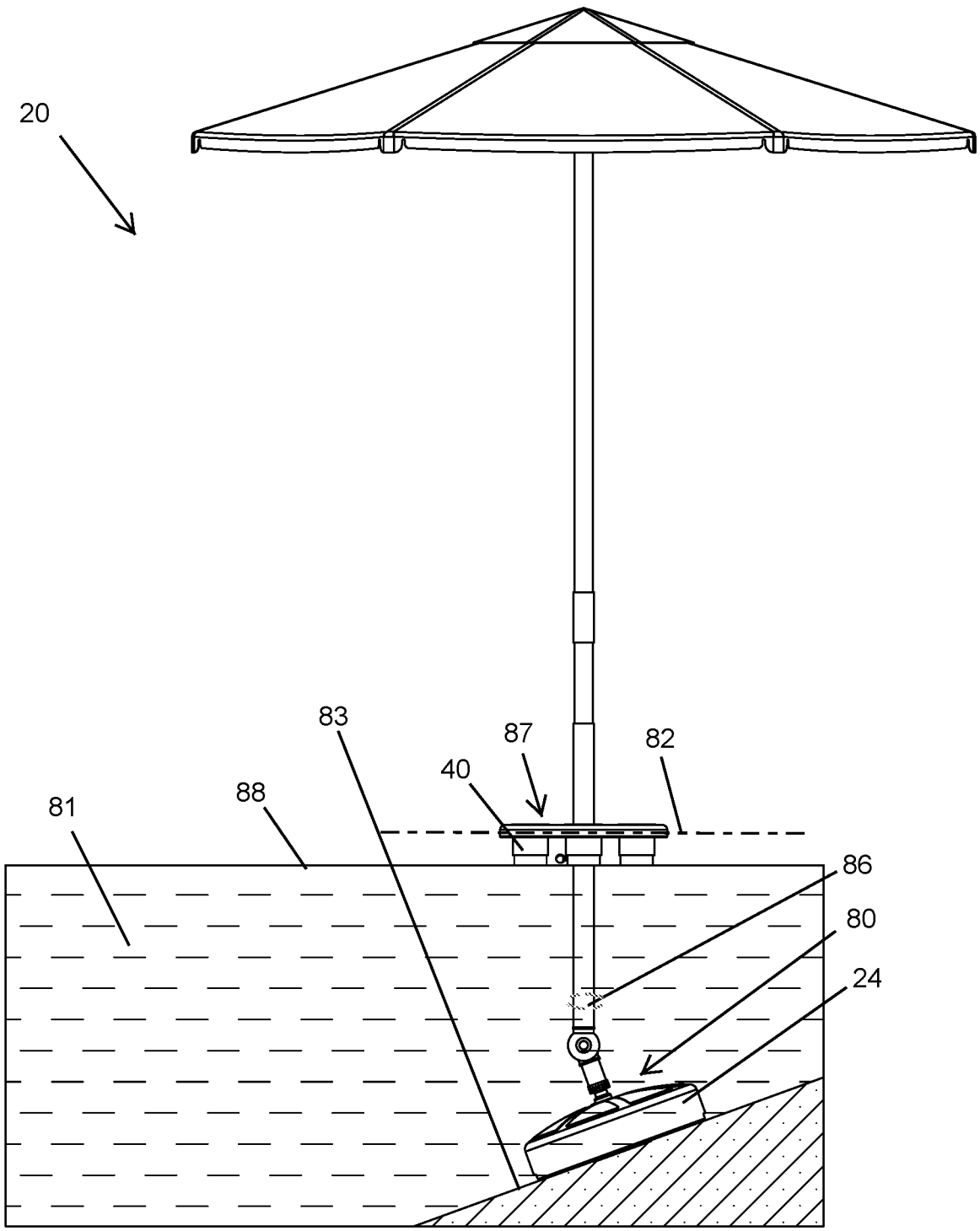
FIG. 14 is a side-elevational view of the umbrella support structure positioned on an exaggerated sloped bottom surface of a pool wherein the articulating mechanism is pivoted to maintain the cup holder horizontally parallel to a horizontal top water level of the pool, in accordance with a non-limiting exemplary embodiment of the present disclosure.
Figure 15:
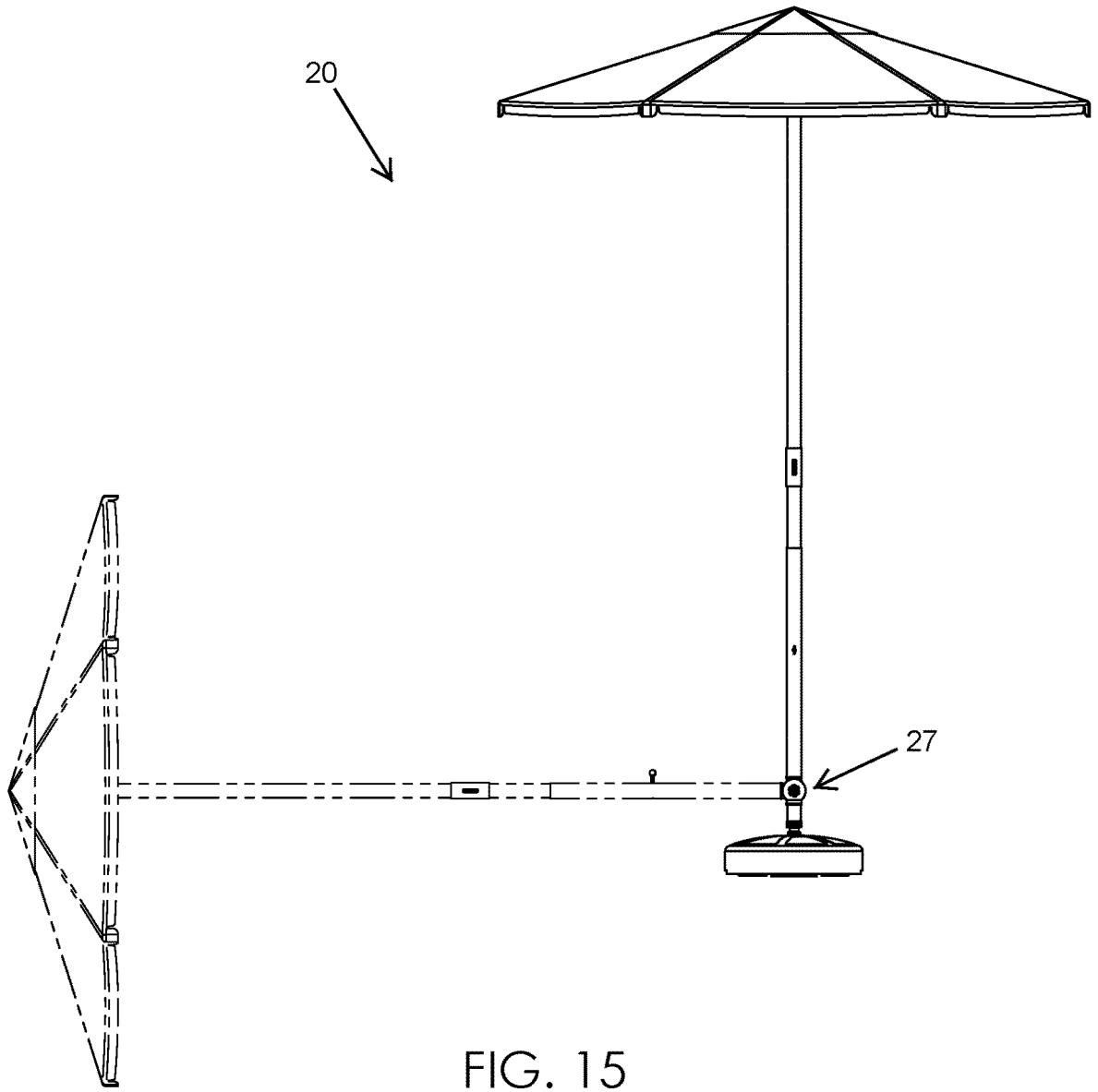
FIG. 15 is a side-elevational view showing an exaggerated pivoting motion of the umbrella support structure, in accordance with a non-limiting exemplary embodiment of the present disclosure.
Figure 16:
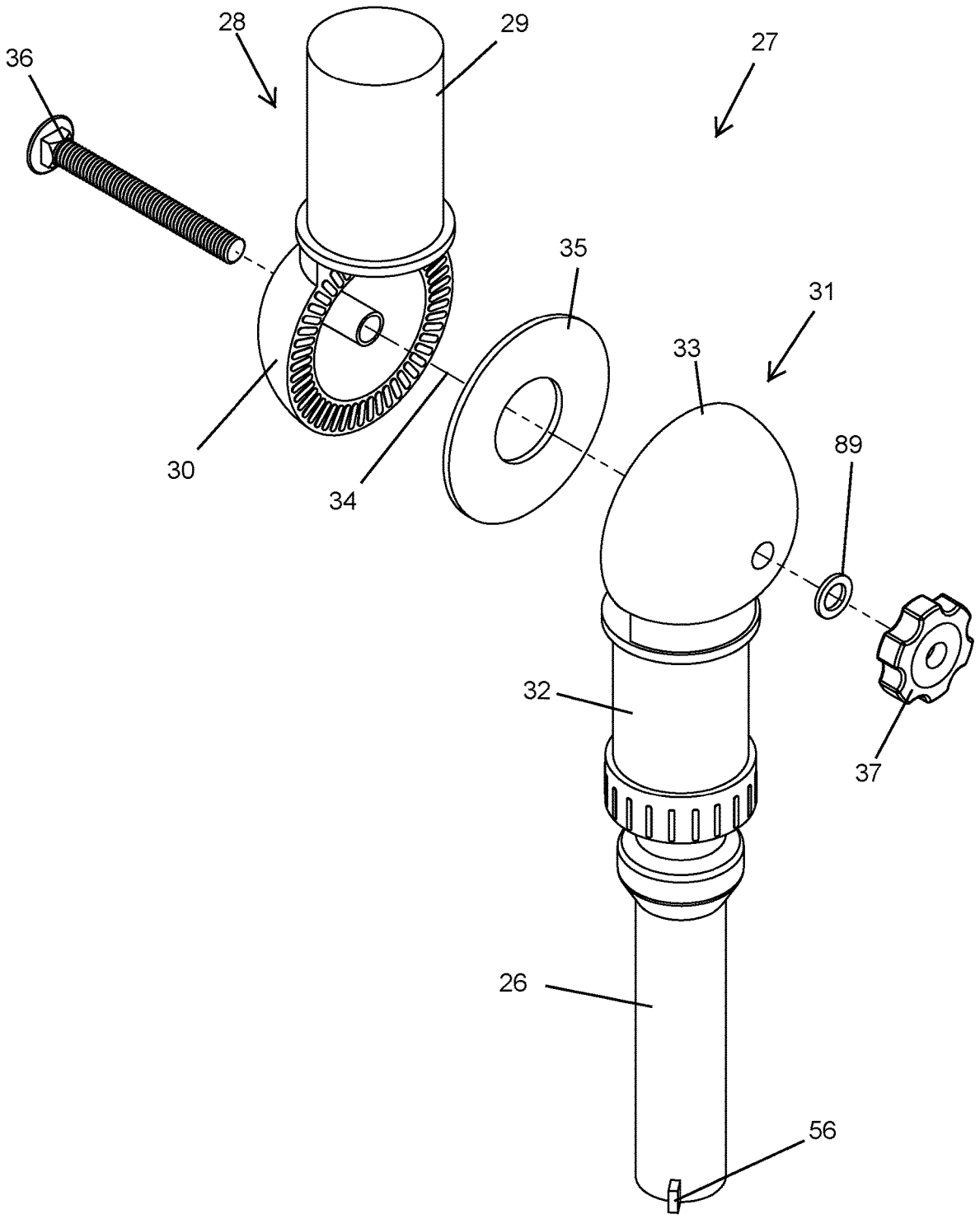
FIG. 16 is an exploded view of the articulating mechanism, in accordance with a non-limiting exemplary embodiment of the present disclosure.

In a non-limiting exemplary embodiment, the support structure 20 and cup-holder tray 40 together are a stand-alone structure. A variety of umbrella canopies 21 can be purchased separately and removably attached to the support structure 20, as desired. FIG. 14 illustrates an exaggerated slope (incline/decline) bottom surface of a pool to exemplify how the support structure 20 can be pivoted while maintaining the cup holder tray 40 at a horizontal position. FIG. 15 illustrates an exaggerated pivot angle of about ninety degrees. Practically speaking, the support structure 20 may not be pivoted more than about forty-five degrees, depending on the sloped surface of the pool and water depth.

In a non-limiting exemplary embodiment, the base 24, the base connector 26, and a lower portion of the articulating mechanism 27 are configured to synchronously remain at the non-equilibrium sloped position 80 and angularly offset from the horizontal plane 82 and the centrally registered longitudinal axis 23, respectively, while the cup holder tray 40 is articulated above the top water level surface 88 of the pool 81.

In a non-limiting exemplary embodiment, the at least one extension pole 22 and an upper portion of the articulating mechanism 27 are configured to be freely pivoted in sync relative to the non-equilibrium sloped position 80 of the base 24, the base connector 26, and a lower portion of the articulating mechanism 27 such that the cup holder tray 40 is maintained at an equilibrium position parallel to the horizontal plane 82 and above the top water level surface 88 of the pool 81.

In a non-limiting exemplary embodiment, the articulating mechanism 27 includes a first connector 28 having a hollow tubular top end 29 attached to the at least one extension pole 22, and further having a first adjustable portion 30 provided with a first plurality of teeth 30*a* opposed from the hollow tubular top end 29. A second connector 31 has a hollow tubular bottom end 32 attached to the base connector 26, and further has a second adjustable portion 33 provided with a second plurality of teeth 33*a* opposed from the hollow tubular bottom end 32. A rubber washer 35 is intercalated between the first plurality of teeth 30*a* and the second plurality of teeth 33*a*. Advantageously, the first plurality of teeth 30*a* are rotatably affixed to the second plurality of teeth 33*a* such that the at least one extension pole 22 is selectively articulated between alternate angles relative to the non-equilibrium sloped position 80 of the base 24 and about a fulcrum axis 34 registered orthogonal to the centrally registered longitudinal axis 23. It is noted that the rubber washer 35 may have an initial flat surface and does not need to be serrated. The teeth 30*a*, 33*a* will make indentations in the rubber washer 35 to maintain a firm grip and provide stable adjustability without undesirably slippage of the desired angle.

In a non-limiting exemplary embodiment, the articulating mechanism 27 further includes an exterior washer 89 positioned exterior of the second adjustable portion 33, and a first fastener 36 is passed through the first adjustable portion 30, the second adjustable portion 33, and the exterior washer 89. A knob 37 is in threaded engagement with the first fastener 36 and the exterior washer 89 for selectively adjusting a tilt angle of the first adjustable portion 30 relative to the second adjustable portion 33.

In a non-limiting exemplary embodiment, an umbrella canopy 21 is attached to the at least one extension pole 22.

The present disclosure further includes a method of utilizing a beverage holding support structure 10 for holding a beverage in a pool 81. Such a method includes the steps of: accessing a pool 81; providing and disposing a base 24 at a non-equilibrium sloped position 80 within the pool 81, relative to a horizontal plane 82, and parallel to a sloped bottom surface 83 of the pool 81; providing a base connector 26 having a centrally registered longitudinal axis 23; connecting the base connector 26 to the base 24; providing and adjustably coupling an articulating mechanism 27 to the base connector 26; extending the articulating mechanism 27 upwardly from the base connector 26; providing and aligning at least one extension pole 22 with the centrally registered longitudinal axis 23; statically affixing the at least one extension pole 22 to an upper portion of the articulating mechanism 27; providing and attaching a cup holder tray 40 to the at least one extension pole 22 wherein the beverage holding support structure has a center of gravity 86 located proximate to the base 24 and distal to the cup holder tray 40; and the center of gravity 86 prohibiting the base 24 from being tipped over from the non-equilibrium sloped position 80 while the cup holder tray 40 is maintained at a horizontal position 87 parallel to the horizontal plane 82 above a top water level surface 88 of the pool 81.

In a non-limiting exemplary embodiment, the articulating mechanism 27 is configured to specifically rotate (tilt) an umbrella canopy and cup holder tray 40 between 0-90 degrees, and preferably between 0-45 degrees, based on the sloped (angled) bottom surface of the pool 81. To achieve such a delicate rotation within a body of water (pool 81), articulating mechanism 27 has coextensively (same shaped) first connector 28 and second connector 31 each having a mating surface provided with a plurality of teeth 30*a*, 33*a*, respectively. A flexible rubber washer 35 or gasket is intercalated between such teeth and helps ensure the first connector 28 is securely mated to the second connector 31 at alternate angled positions relative to each other. For example, the second connector 31 may be vertically aligned with the umbrella base connector 26 and the first connector 28 may be articulated between 0-45 degrees relative to the umbrella base connector 26 thereby tilting the cup holder tray 40 and/or the umbrella to a position that is registered horizontal and parallel with a top surface 88 of the body of water 81. In this manner, beverages supported in the cup holder tray 40 are maintained at a horizontal plane 82 parallel with the water top surface 88 even though the bottom surface 83 of the pool 81 is sloped or angled relative to the horizontal plane 82 and water top surface 88. It is noted that without the teeth 30*a*, 33*a* at the first connector 28 and second connector 31, respectively, and rubber washer 35 intercalated therebetween, the weight of the umbrella and/or cup holder tray 40 will cause the at least one extension pole 22 to slip relative to the base connector 26. Such slippage occurs at the first connector 28 and second connector 31 and causes the cup holder tray 40 and the at least one extension pole 22 to pivot beyond a desired angular threshold thereby causing beverages in the cup holder tray 40 to fall over and spill in the pool 81.

Experiments were conducted with non-teethed (flat) connector faces for the articulating mechanism 27. Even with a lot of torque applied to the fastener 36 at the first connector 28 and second connector 31, the weight of the cup holder tray 40 and the umbrella canopy 21 causes the connection between the first connector 28 and second connector 31 to slip and fail. Thus, the connector teeth 30*a*, 33*a* and rubber washer 35 are crucial for the structural configuration to work in a pool 81 where the angular adjustments can be made in the pool 81 without having to use cumbersome hand tools to tighten and secure the first connector 28 to the second connector 31 at an angle where the cup holder tray 40 is parallel with the top water level surface 88 in the pool 81.

In a non-limiting exemplary embodiment, the at least one extension is preferably solvent welded as a permanent connection to the articulating mechanism 27. It is noted the at least one extension pole 22 may be separate from the umbrella canopy 21 such that a variety of umbrella canopies can be removably attached to the at least one extension pole 22.

In a non-limiting exemplary embodiment, the structural of the base 24, base connector 26, articulating mechanism 27, and the at least one extension pole 22 is configured to permit angular tilting of the cup holder tray 40 parallel with the top water level surface 88. In particular, most pools 81 have a sloped bottom surface 83, so that a straight pole coming out of a conventional base will cause a cup holder tray to register at a non-horizontal (non-equilibrium) position that is not level or parallel with the top water level surface 88 (e.g., waterline). To overcome this shortcoming, the present disclosure provides a tilt (angle) at the bottom of the at least one extension pole 22 (via the articulating mechanism 27 located proximate to the base 24) allows the center of gravity 86 of the support structure 20 to be proximate to and very close to the base 24 and not at a mid-point of the at least one extension pole 22. If the articulating mechanism 27 was located at a mid-point of the at least one extension pole 22, the weight of an umbrella added to the at least one extension pole 22 would raise the center of gravity 86 to or near the mid-point of the at least one extension pole 22 and such weight would push down (via torque) on the articulating mechanism 27 causing the base 24 to tip over. The structural configuration of the present disclosure overcomes such a shortcoming. Furthermore, if the articulating mechanism 27 was located higher than just above the base 24 (as shown in the figures), the at least one extension pole 22 would stick out away from the base 24 and not allow the user to get close to the cup holder tray 40. The cup holder tray 40 would be offset to the side of the articulating mechanism 27 and cause the user to trip over the base 24 trying to get to the cup holder tray 40.

In a non-limiting exemplary embodiment, cup holder tray 40 is designed to be slidably adjusted along a longitudinal length of the at least one extension pole 22. For example, the cup holder tray 40 can be adjusted in height from right above the articulating mechanism 27 to a top end of the at least one extension pole 22.

In a non-limiting exemplary embodiment, the cup holder tray 40 may be integrated with the at least one extension pole 22. As noted above, the umbrella canopy 21 may be selectively removed such that the cup holder tray 40 is used with the umbrella canopy 21.

In a non-limiting exemplary embodiment, the low center of gravity 86 near the base 24 alleviates the need to place sandbags over it to weigh it down.

In a non-limiting exemplary embodiment, the support structure 20 employs components that rust and corrosion resistant for use inside saltwater chlorine pools 81.

In a non-limiting exemplary embodiment, the articulating mechanism 27 may include a stainless-steel washer 37 between the fastener 36 and the outer wall of one of the connectors 28, 31 helps reduce friction therebetween so the first connector 28 can be tightened by hand to the second connector 31 with less friction. Without the washer 37, extra surface contact friction will cause wear and tear on the outside surface of the connector 31.

In a non-limiting exemplary embodiment, the base connector 26 may be eliminated wherein the extension pole 22 press fits directly into the base 24 for an accurate fit.

While non-limiting exemplary embodiment(s) has/have been described with respect to certain specific embodiment (s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A beverage holding support structure for in a pool, said support structure comprising:

a base configured to be disposed at a non-equilibrium sloped position within a pool, relative to a horizontal plane, and parallel to a sloped bottom surface of the pool;

a base connector having a centrally registered longitudinal axis and being connected to said base;

an articulating mechanism coupled to said base connector and extended upwardly therefrom;

at least one extension pole aligned with said centrally registered longitudinal axis and affixed to an upper portion of said articulating mechanism; and a cup holder tray attached to said at least one extension pole;

wherein said beverage holding support structure has a center of gravity located proximate to said base and distal to said cup holder tray;

wherein said beverage holding support structure is configured to prohibit said base from being tipped over from said non-equilibrium sloped position while said cup holder tray is maintained at a horizontal position parallel to the horizontal plane above a top water level surface of the pool;

wherein said articulating mechanism includes a first connector having a hollow tubular top end attached to said at least one extension pole, and further having a first adjustable portion provided with a first plurality of teeth opposed from said hollow tubular top end, and a second connector having a hollow tubular bottom end attached to said base connector, and further having a second adjustable portion provided with a second plurality of teeth opposed from said hollow tubular bottom end, and a rubber washer intercalated between said first plurality of teeth and said second plurality of teeth;

wherein said first plurality of teeth are rotatably affixed to said second plurality of teeth such that said at least one extension pole is selectively articulated between alternate angles relative to said non-equilibrium sloped position of said base and about a fulcrum axis registered orthogonal to the centrally registered longitudinal axis.

2. The beverage holding support structure of claim 1, wherein said base, said base connector, and a lower portion of said articulating mechanism are configured to synchronously remain at said non-equilibrium sloped position and angularly offset from the horizontal plane and the centrally registered longitudinal axis, respectively, while said cup holder tray is articulated above the top water level surface of the pool.

3. The beverage holding support structure of claim 1, wherein said at least one extension pole and an upper portion of said articulating mechanism are configured to be freely pivoted in sync relative to said non-equilibrium sloped position of said base, said base connector, and a lower portion of said articulating mechanism such that said cup holder tray is maintained at an equilibrium position parallel to the horizontal plane and above the top water level surface of the pool.

4. The beverage holding support structure according to claim 1, wherein said articulating mechanism further comprises:

an exterior washer positioned exterior of said second adjustable portion;

a first fastener passed through said first adjustable portion, said second adjustable portion, and said exterior washer; and a knob in threaded engagement with said first fastener and said exterior washer for selectively adjusting a tilt angle of said first adjustable portion relative to said second adjustable portion.

5. The beverage holding support structure according to claim 1, further comprising:

an umbrella canopy attached to said at least one extension pole.

6. A beverage holding support structure for use in a pool, said beverage holding support structure comprising:

a base configured to be disposed at a non-equilibrium sloped position within a pool, relative to a horizontal plane, and parallel to a sloped bottom surface of the pool;

a base connector having a centrally registered longitudinal axis and being connected to said base;

an articulating mechanism adjustably coupled to said base connector and extended upwardly therefrom;

at least one extension pole aligned with said centrally registered longitudinal axis and statically affixed to an upper portion of said articulating mechanism; and a cup holder tray attached to said at least one extension pole;

wherein said beverage holding support structure has a center of gravity located proximate to said base and distal to said cup holder tray;

wherein said center of gravity is configured to prohibit said base from being tipped over from said non-equilibrium sloped position while said cup holder tray is maintained at a horizontal position parallel to the horizontal plane above a top water level surface of the pool;

wherein said articulating mechanism includes a first connector having a hollow tubular top end attached to said at least one extension pole, and further having a first adjustable portion provided with a first plurality of teeth opposed from said hollow tubular top end, and a second connector having a hollow tubular bottom end attached to said base connector, and further having a second adjustable portion provided with a second plurality of teeth opposed from said hollow tubular bottom end, and a rubber washer intercalated between said first plurality of teeth and said second plurality of teeth;

wherein said first plurality of teeth are rotatably affixed to said second plurality of teeth such that said at least one extension pole is selectively articulated between alternate angles relative to said non-equilibrium sloped position of said base and about a fulcrum axis registered orthogonal to the centrally registered longitudinal axis.

7. The beverage holding support structure of claim 6, wherein said base, said base connector, and a lower portion of said articulating mechanism are configured to synchronously remain at said non-equilibrium sloped position and angularly offset from the horizontal plane and the centrally registered longitudinal axis, respectively, while said cup holder tray is articulated above the top water level surface of the pool.

8. The beverage holding support structure of claim 7, wherein said at least one extension pole and an upper portion of said articulating mechanism are configured to be freely pivoted in sync relative to said non-equilibrium sloped position of said base, said base connector, and a lower portion of said articulating mechanism such that said cup holder tray is maintained at an equilibrium position parallel to the horizontal plane and above the top water level surface of the pool.

9. The beverage holding support structure according to claim 6, wherein said articulating mechanism further comprises:

an exterior washer positioned exterior of said second adjustable portion;

a first fastener passed through said first adjustable portion, said second adjustable portion, and said exterior washer; and a knob in threaded engagement with said first fastener and said exterior washer for selectively adjusting a tilt angle of said first adjustable portion relative to said second adjustable portion.

10. The beverage holding support structure according to claim 9, further comprising: an umbrella canopy attached to said at least one extension pole.

11. A method of utilizing a beverage holding support structure for holding a beverage in a pool, the method comprising the steps of:

accessing a pool;

providing and disposing a base at a non-equilibrium sloped position within the pool, relative to a horizontal plane, and parallel to a sloped bottom surface of the pool;

providing a base connector having a centrally registered longitudinal axis;

connecting said base connector to said base;

providing and adjustably coupling an articulating mechanism to said base connector;

extending said articulating mechanism upwardly from said base connector;

providing and aligning at least one extension pole with said centrally registered longitudinal axis;

statically affixing said at least one extension pole to an upper portion of said articulating mechanism;

providing and attaching a cup holder tray to said at least one extension pole;

wherein said beverage holding support structure has a center of gravity located proximate to said base and distal to said cup holder tray; and said center of gravity prohibiting said base from being tipped over from said non-equilibrium sloped position while said cup holder tray is maintained at a horizontal position parallel to the horizontal plane above a top water level surface of the pool;

wherein said articulating mechanism includes a first connector having a hollow tubular top end attached to said at least one extension pole, and further having a first adjustable portion provided with a first plurality of teeth opposed from said hollow tubular top end, and a second connector having a hollow tubular bottom end attached to said base connector, and further having a second adjustable portion provided with a second plurality of teeth opposed from said hollow tubular bottom end, and a rubber washer intercalated between said first plurality of teeth and said second plurality of teeth;

wherein said first plurality of teeth are rotatably affixed to said second plurality of teeth such that said at least one extension pole is selectively articulated between alternate angles relative to said non-equilibrium sloped position of said base and about a fulcrum axis registered orthogonal to the centrally registered longitudinal axis.

* * * * *